US005899819A

United States Patent [19]

Mount et al.

[11] Patent Number: 5,899,819

[45] Date of Patent: May 4, 1999

[54] GOLF PUTTER

[76] Inventors: Gregory T. Mount, 6234 Northwoods Glen Dr., Parker, Colo. 80134; Roderick A. Ball, 14242 E. Hawaii Cir., Aurora, Colo. 80012

[21] Appl. No.: 08/856,404

[22] Filed: May 14, 1997

[51] Int. Cl.[6] ..... A63B 69/36; A63B 53/04

[52] U.S. Cl. ..... 473/329; 473/340

[58] Field of Search ..... 473/324, 325, 473/329, 332, 340, 342, 350, 251, 219

[56] References Cited

U.S. PATENT DOCUMENTS

| | | | |
|---|---|---|---|
| 726,885 | 5/1903 | Dunn . | |
| 890,836 | 6/1908 | Beale . | |
| 1,562,956 | 11/1925 | Guerne . | |
| 1,939,414 | 12/1933 | Sametz . | |
| 2,912,245 | 11/1959 | Gardner et al. . | |
| 4,805,922 | 2/1989 | Whitfield . | |
| 5,316,304 | 5/1994 | Yost | 473/330 |
| 5,407,196 | 4/1995 | Busnardo . | |
| 5,643,109 | 7/1997 | Rose et al. | 473/329 |

FOREIGN PATENT DOCUMENTS

| | | | |
|---|---|---|---|
| 646942 | 8/1962 | Canada | 273/80.7 |

*Primary Examiner*—Sebastiano Passaniti
*Attorney, Agent, or Firm*—Holland & Hart LLP

[57] ABSTRACT

A golf putter is provided which includes a golf club shaft having a first end and a putter head assembly. The putter head assembly includes a main body member, a front face portion and a back face portion. A recessed area is defined by the front face portion. A resilient member circumferentially surrounds the head assembly including the recessed area to form a front striking surface of the head assembly at the front face portion. Finally, a mechanism is provided for adjusting the tension of the resilient member across the front face portion.

12 Claims, 2 Drawing Sheets

GOLF PUTTER

BACKGROUND OF THE INVENTION

1. Field of the Invention

This invention relates generally to golf clubs and, more particularly, to a golf putter having a resilient striking face. Specifically, the present invention relates to a golf putter design wherein the resilient striking face is adjustable to the needs of a golfer.

2. Description of the Prior Art

A typical round of golf involves 18 holes of play with par being generally 72 strokes for most courses. Preferably, a hole of golf involves a drive shot, a fairway shot and two putts. In such an example, 36 strokes of the 72 strokes of a round of golf utilize a putter. Of course, for most golfers the putter will be used even more often depending upon the golfer's ability. Consequently, a great deal of attention is focused on the putting aspect of the game of golf. In response to this, the design and construction of golf putters have undergone significant changes over the years.

Putters have been constructed from a wide variety of materials and have exhibited a multitude of designs over the years. A golf putter typically has a metal head secured to a shaft with or without a hosel, and the head generally has a striking face with a loft of several degrees. This loft is preferably designed into the face due to the fact that when a ball is putted, it initially moves across the green by sliding. As the frictional forces of the green cause the spin rate of the ball to increase, the ball eventually stops sliding and begins to spin or roll, and it is while the ball is rolling that the putt has the greatest amount of directional stability due primarily to the inertia created by the rolling ball. Consequently, it would follow that the sooner the ball begins to roll, the greater the control a player has over his putt. This is particularly true on very well kept greens. By utilizing a putter having a negative loft, then, top spin is imparted to the ball when struck which increases the tendency of the ball to roll rather than slide.

A number of designs have been created to increase this top spin upon striking of the ball. One area of club head design is in the use of inserts at the striking face of the putter. These inserts are intended, at times, to change the loft angle and in other instances to provide a different resiliency due the use of different materials in the insert. An example of putter or golf club head designs utilizing inserts or materials to change the resiliency of the face of the head include those disclosed in U.S. Pat. No. 1,562,956, No. 1,939,414, No. 4,805,922, No. 5,407,196 and a French Patent to Marcorelles.

Other putter head designs which are intended to increase resiliency of the club head as well as to provide more top spin include club head designs having cores of different materials such as disclosed in U.S. Pat. No. 726,885. Still another technique of altering the top spin of a ball when struck by a putter involves the use of synthetic covers for today's golf ball. Since the cover of the golf ball has become harder in recent years, it has become desirable to provide a softer striking face for the putter in order to accommodate the harder ball.

Still another design for enhancing resiliency to the club head of a golf club, as opposed to a putter, is disclosed in U.S. Pat. No. 890,836. In this patent, a plurality of strings are wound about a frame which is then secured to the face of a golf club, and once the desired tension is achieved with the strings, they are soldered in place in order to prevent unwinding and to retain the desired resiliency.

One of the other concerns in designing and using a putter is that of dwell time, that is the amount of time that the putter face and the ball are together. Different types of inserts or putter face materials maintain the ball and the putter face in contact for various microseconds at impact. In other words, some inserts for putter faces hold the ball to the face a bit longer than others. Thus, the softer the ball and/or the softer the putter face, the greater the dwell time, which increases accuracy. Moreover, increased dwell time reduces the skid time and enables a putter to provide more top spin and more quickly initiate rolling on the green. All of this enables a golfer to control his or her putts and increase putting accuracy.

Unfortunately, changes in technology have enabled ball manufacturers to provide golf balls of various different hardness and these, coupled with putters having striking faces of various different resiliencies, provide combinations of significant differences. This is added to the fact that each golfer has his or her own unique putting stance and capabilities. Therefore, it would be highly desirable to have a putter wherein the striking face is not only resilient to provide more dwell time and increase top spin, but would enable the golfer to adjust the resiliency of the putter face for his or her own needs or desires depending on the types of golf balls that the golfer is utilizing as well as golfer preferences. To date, such a putter head design does not exist, and it would be highly desirable to provide a putter with such capabilities.

SUMMARY OF THE INVENTION

Accordingly, it is one object of the present invention to provide a golf putter design having improved ball control characteristics.

It is another object of the present invention to provide a golf putter head which has significant resiliency to increase dwell time and impart top spin to a golf ball.

Yet another object of the present invention is to provide a golf putter head design which permits the resiliency of the putter face to be adjusted in accordance with the desires and needs of the golfer.

Still another object of the present invention is to provide a golf putter that has significantly increased "feel" and is much softer and quieter than prior golf putter designs.

To achieve the foregoing and other objects and in accordance with the purpose of the present invention, as embodied and broadly described herein, a golf putter is provided which includes a golf club shaft having a first end and a putter head assembly. The putter head assembly includes a main body member, a front face portion and a back face portion. A recessed area is defined by the front face portion. A resilient member circumferentially surrounds the head assembly including the recessed area to form a front striking surface of the head assembly at the front face portion. Finally, a mechanism is provided for adjusting the tension of the resilient member across the front face portion.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Figure 1:
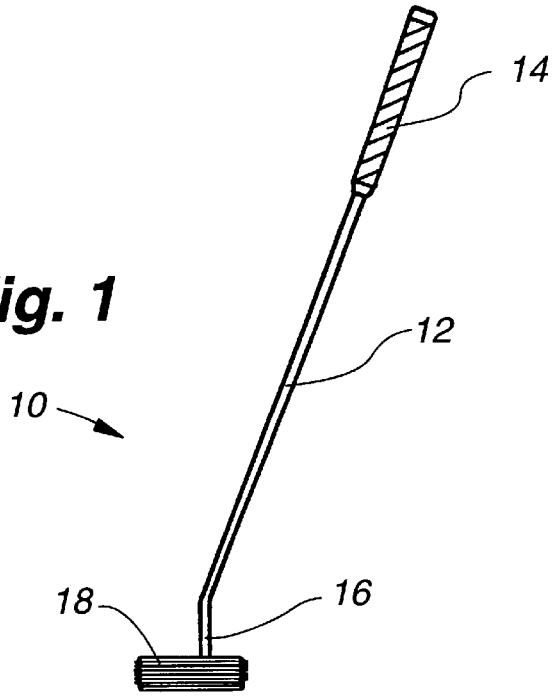
FIG. 1 is a reduced front perspective view of a golf putter constructed in accordance with the present invention.

Referring first to FIG. 1, a golf putter 10 includes a shaft 12 and a grip or handle 14 of substantially conventional design. The shaft 12 may include a hosel 16, which is an angled portion of the shaft immediately connecting to the putter head 18. It should be understood that the shaft 12 and handle 14 may be of any design for use with the putter head 18 of the present invention.

Figure 2:
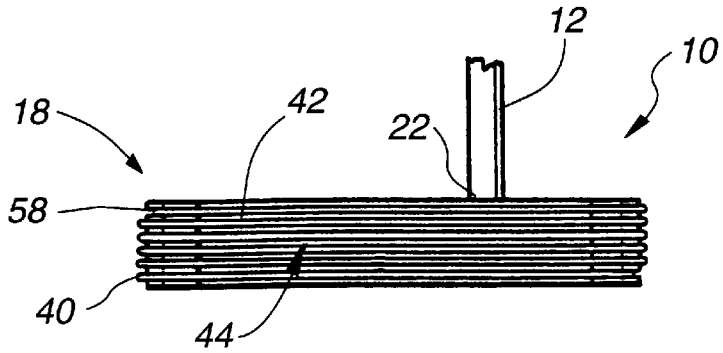
FIG. 2 is a front perspective view of one embodiment of the putter head design constructed in accordance with the present invention.
Figure 3:
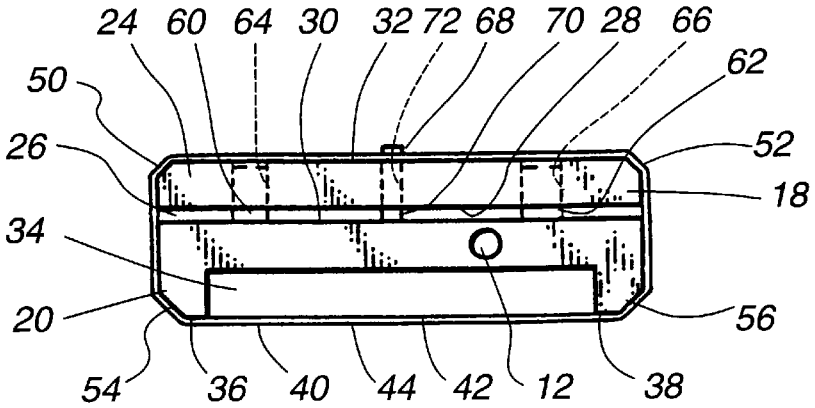
FIG. 3 is a top perspective view, with some parts in shadow, of the putter head embodiment illustrated in FIG. 2.
Figure 4:
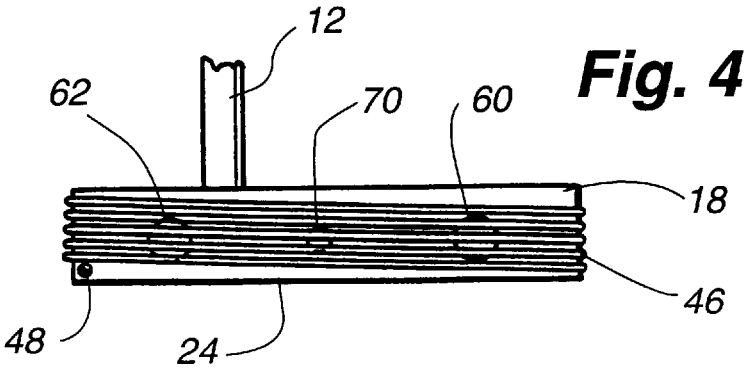
FIG. 4 is rear perspective view of the putter head embodiment illustrated in FIG. 2.

Referring to FIGS. 2–4, the putter head 18 in preferred form includes a main body member or element 20 to which the shaft 12 is preferably secured at 22. In preferred form, a second body member or element 24 is provided in a spaced position so as to create a spacing 26 therebetween. In one preferred embodiment, the second body member 24 is positioned so that the front face 28 thereof is spaced immediately behind the rear face 30 of the main body element 20 so that the rear surface 32 of the second body member 24 forms the rear face of the putter head 18.

The front face portion of the main member 20, opposite the rear surface 32, includes a recessed area 34. In preferred form, a pair of ears or tabs 36, 38 project outwardly and forwardly of the main body member 20 to form the recessed area 34. In preferred form, the main body member 20 is substantially rectangular in shape and form as is the second body member 24. In this manner, the ears 36, 38 create a substantially U-shaped cross-section for the main body 20 due to the recessed area 34.

A resilient member 40 surrounds the main body member 20 and second body member 24 to form a resilient front face or striking face 42 in front of the recessed area 34. In preferred form, the resilient member 40 is in the form of a plurality of string or wire windings 44. The windings 44 may be in the form of separate individual wire wraps which are disposed about the circumference of the head 18, or they may be in the form of one single wire member 46 that is wrapped a plurality of times about the circumference of the head member 18. In this instance, the wire 46 is secured at each end to the main body member 20 and second body member 24. One such attachment is illustrated at 48.

To assist in the location of the wire windings 44, a pair of land surfaces 50, 52 are disposed at the outside corners of the second body member 24, and a similar pair of land surfaces 54, 56 are disposed along the front comers of the main body member 20. A plurality of notches 58 are disposed in each of the corner land surfaces 50, 52, 54 and 56 to provide channels or guides for the wire wraps 44 in order to maintain the wire wraps 44 in secure position about the circumference of the head 18. Otherwise, the wire wraps 44 are likely to slide along the outer surface of the body members 20 and 24 and thus provide improper operation of the putter head 18. As a result of this particular structure, the striking face 42 is made up of a plurality of tightly wound wire wraps 44 which impact the golf ball when the putter 10 is swung.

In order to securely align the second body member 24 relative to the main body member 20, a pair mounting members in the form of mounting pins 60 and 62 are preferably secured to the rear face 30 of the main body member 20. A plurality of apertures or bores 64 and 66 are provided through the second body member 24 and are sized to snugly receive the mounting pins 60 and 62, respectively. In this manner, the second mounting member 24 is designed to move relative to the main body member 20 along the mounting pins 60 and 62.

To adjust the tension of the string wraps 44 particularly at the front face 42 so as to provide varying resilient forces at the front face 42, a tension adjustment member 68 is provided for moving the second body member 24 relative to the main body member 20 against the restraining force of the wire wraps 44. In this manner, the spacing 26 may be varied, and the greater the spacing 26, the tighter the wraps 44 about the face 42 and the greater the tension at the face 42. Likewise, the smaller the spacing 26, the looser the string wraps 44 and the less tension provided at the front face 42.

In preferred form, the tension member 68 is in the form of a set screw 70 which is threaded and engages a threaded aperture 72 which is disposed in the second body element 24. In preferred form, the threaded aperture 72 is positioned between the two bores 64 and 66 so as to center the tensioning member 68 relative to the body members 20 and 24. In this manner, the set screw 70 may be tightened against the rear face 30 of the main body member 20 and thus force the second body member 24 away from the front main body member 20 and increase the spacing 26. This movement increases the tension of the wire wraps 44 at the front face 42. Likewise, by turning the set screw 70 away from the main body member 20, the spacing 26 is reduced and the tension at the front face 40 of the wire wraps 44 is likewise reduced. In preferred form, the head of the set screw 70 is recessed within the aperture 72 so as to require a small screw driver or other specialized tool to make the adjustments to the set screw 70. In this manner, the set screw 70 will not be inadvertently or easily adjusted so as to accidentally vary the tension of the front face 42.

The United States Golf Association, at the present time, permits putters to be adjustable provided that the adjustment cannot be readily made, and that all adjustable parts are firmly fixed so that there is no reasonably likelihood of them working loose during a round. As indicated previously, the set screw 70 is recessed within the aperture 72 so as to make adjustment of the set screw 70 and thus adjustment of the tension of the string wraps 44 at the front face 42 difficult. Moreover, a plug 74 is threadably engaged within the aperture 72 once the set screw 70 has been appropriately adjusted so that the set screw 70 cannot inadvertently work itself loose along the threads of the aperture 72 since the plug 74 is firmly fixed against the head of the set screw 70 within the aperture 72. Moreover, the plug 74 will prevent easy access and thus adjustment of the set screw 70 during a round of golf. However, a golfer may readily adjust the tension of the wraps 44 at the striking face 42 by removing the plug 74 and then turning the set screw 70 clockwise to tighten or counter-clockwise to loosen the tension at the front face 42. When the desired tension is accomplished, the plug 74 is threadably engaged with the aperture 72 so as to fix the set screw 70 in place.

Figure 5:
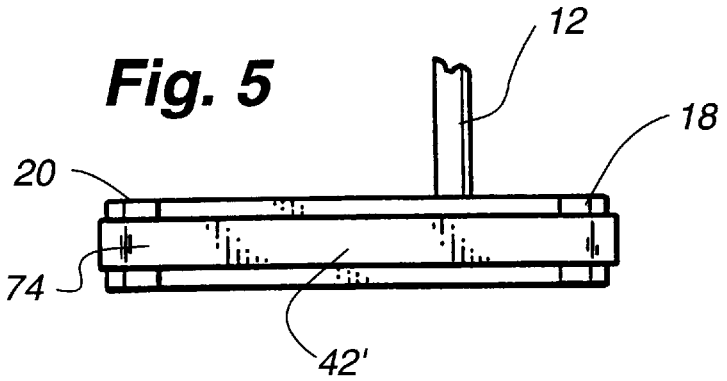
FIG. 5 is a front perspective view of an alternate resilient member embodiment for use with a putter head constructed in accordance with the present invention.
Figure 6:
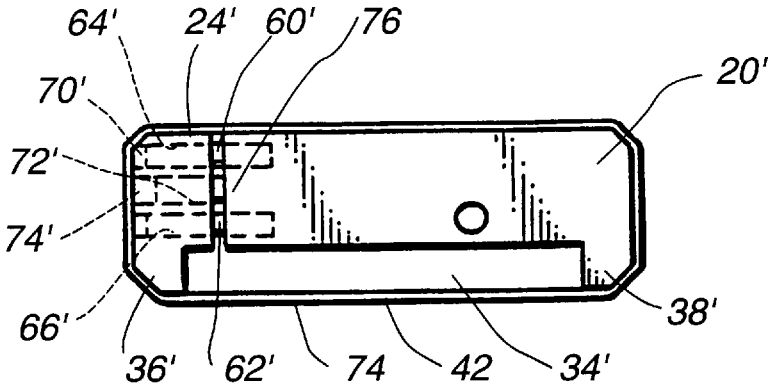
FIG. 6 is a top perspective view of yet another embodiment of the putter head resiliency adjustment mechanism constructed in accordance with the present invention.
Figure 7:
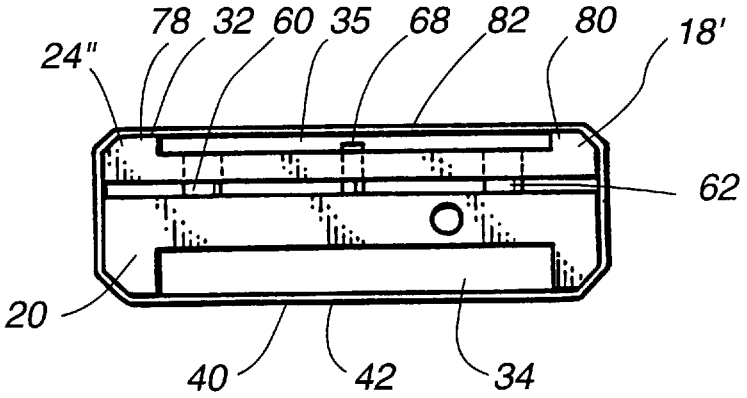
FIG. 7 is a top perspective view of still another embodiment of the putter head constructed in accordance with the present invention and illustrating a dual face, putter head design.

Referring to FIGS. 5–7, some alternate embodiments of the golf head design of the present invention are illustrated.

In FIG. 5, a single rubber band member 74 is utilized as the resilient member 40 in lieu of individual wire wraps 44. The rubber band 74 has height dimension sufficiently large so as to be at least 50% the height of the main body member 20 and second body member 24. In this manner, the rubber band 74 provides a striking surface 42'. The tension of the rubber band member 74 is adjusted in the same manner as the tension of the wire wraps 44 as previously described.

An alternate construction for the putter head 18 of the present invention is illustrated in FIG. 6 and includes a main body member 20' and second body member 24' spaced from the main body member 20'. In this particular embodiment, however, the second body element 24' is positioned off one end 76 of the main body member 20', as opposed to behind the rear surface of the main body member 20 of the previous embodiment. In this instance, an ear or tab 38' projects forwardly from the front portion of the main body member 20', and a similar ear portion 36' projects forwardly from the second body member 24' so as to form the recessed area 34'. Resilient member 40 is wrapped about the main body member 20' and second body member 24' so as to form the front striking face 42 at the recessed area 34' similar to the prior embodiment.

A pair of mounting pins 60' and 62' are secured to the main body portion 20' at the end 76 thereof and project into a pair of apertures 64', 66', respectively, in the second body member 24' similar to the prior embodiment. These pins 60' and 62' maintain the position of the second body member 24' relative to the main body member 20'. Likewise, and similar to the prior embodiment, a tension member 68 is provided in the second body member 24' and in this instance is in the form of a set screw 70' positioned within a bore 72' for threaded movement therewithin. A plug 74' secures the position of the set screw 70' as in the prior embodiment. In this instance, however, the spacing 26' between the main body member 20' and second body member 24' is laterally positioned at the end 76 of the main body member 20'. The tension of the resilient member 40 at the front face 42' is adjusted by adjusting the set screw 70' similar to the set screw 70 of the prior embodiment.

Yet another embodiment of the present invention is illustrated in FIG. 7 and illustrates a putter head 18' which is constructed substantially the same as the putter head 18 of FIG. 3 except that a second recessed area 35 is provided. A pair of ears 78 and 80 project rearwardly from the ends of the rear surface 32 of the second body member 24" so as to create the second recessed area 35. The resilient member 40 is wrapped about the main body member 20 and second body member 24" as in the prior embodiments to form a front striking face 42 at the first recessed area 34 and a second, rear striking face 82 at the second recessed area 35. The mounting pins 60 and 62 and the tension member 68 operate in this embodiment in the manner identical to the embodiment illustrated in FIG. 3. However, in this particular embodiment the putter head 18' has 2 striking faces 42 and 82 as opposed to just one, thereby providing a putter head which may be used by both left and right hand golfers.

As can be seen from the above, the golf putter design of the present invention provides a putter having a resiliency capable of adding top spin to the ball upon striking the ball thereby reducing and perhaps even eliminating sliding movement of the ball across a putting green. This action provides more control over the ball and the movement of the ball. Moreover, the present invention provides a golfer with the capability of adjusting the tension of the strings which make up the putter striking face. By adjusting the tension, the golfer can adjust the resilience by which the putter strikes the ball. Therefore, depending on a particular golfer's desires, i.e. whether a golfer wants a hard or a soft feel, the golfer can adjust the tension of the putter face accordingly. Moreover, since different golfers utilize different types of balls, and golf balls vary in degrees of hardness, the golf putter of the present invention again permits a golfer to adjust his putter depending upon his personal needs and desires which include the type of ball he uses, the "feel" that he desires and the like. The present invention also provides an option to have a dual face putter for left and right hand use. These adjustment capabilities of the golf putter design of the present invention provide a golfer with considerably more control and performance variability over putter designs presently on the market.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

We claim:

1. A golf putter comprising:

a golf club shaft having a first end;

a putter head assembly including a main body member, a front face portion, a back face portion, a recessed area defined by said front face portion, and resilient means circumferentially surrounding said head assembly including said recessed area to form a front striking surface of said head assembly at said front face portion; and tension adjustment means for adjusting the tension of said resilient means across said front face portion including a second body member spaced from said main body member and forming a part of said head assembly, said resilient means surrounding said main and said second body members, and means for adjusting the spacing between said main body member and said second body member to vary the tension of said resilient means surrounding said main and second body members.

2. The putter as claimed in claim 1, wherein said spacing adjustment means comprises mounting means secured to said main body member and adapted to project into an opening disposed in said second body member for firm sliding movement therewithin to mount and align said second body member to said main body member, and a threaded tensioning member interconnecting said main body member and said second body member to selectively move said second body member relative to said main body member.

3. The putter as claimed in claim 2, wherein said threaded tensioning member comprises a set screw engaged within a threaded aperture located in said second body member and adapted for engagement against the outer surface of said main body member proximate said mounting means, said mounting means comprising a pin projecting from said main body member into said second body member opening.

4. The putter as claimed in claim 3, wherein said mounting means comprises a pair of said mounting pins secured to said main body member each projecting into respective openings disposed in said second body member, said set screw and threaded aperture being positioned between said pair of mounting pin openings in said second body member.

5. The putter as claimed in claim 1, wherein said second body member comprises a rear body member positioned along and spaced from the back face portion of said main body member opposite said front face portion.

6. The putter as claimed in claim 5, wherein said head assembly includes a second recessed area defined by said second body member along the back surface thereof opposite from the front face portion of said main body member to create a back striking surface and a two-face putter head assembly.

7. The putter as claimed in claim 1, wherein said second body member comprises an end body member spaced from one lateral end of said main body member.

8. The putter as claimed in claim 2, wherein said golf shaft first end is mounted to said main body member.

9. A golf putter head for use with a putter shaft, said head comprising:

a first body element having a front face portion, a rear face portion and a first pocket defined in said front face portion;

a second body element space from said first body element;

resilient means circumferentially surrounding said first and second body elements and crossing said pocket to form a front putting surface at said front face portion; and means for adjusting the tension of said resilient means across said pocket, wherein said tension adjustment means comprises means for adjusting the spacing between said first and second body elements to vary the tension in said resilient means surrounding said first and second body elements.

10. A golf putter head for use with a putter shaft, said head comprising:

a first body element having a front face portion, a rear face portion and a first pocket defined in said front face portion;

a second body element space from said first body element;

resilient means circumferentially surrounding said first and second body elements and crossing said pocket to form a front putting surface at said front face portion; and means for adjusting the tension of said resilient means across said pocket, wherein said tension adjusting means comprises a threaded tensioning member disposed within a threaded bore in said second body element and extending outwardly therefrom against said first body element to move said second body element relative to said first body element against the restraining force of said resilient means, and at least one guide pin secured to and projecting outwardly from said first body element into a passageway disposed in said second body element spaced from said threaded bore.

11. The putter head as claimed in claim 10, wherein said threaded tensioning member comprises a set screw and, wherein said space and adjustment means includes a pair of said guide pins secured to and projecting outwardly from said first head element seated in passageways disposed in said second body element on either side of said set screw for reciprocal movement therewithin in response to movement of said set screw.

12. A golf putter construction having a golf shaft, and a putter head attached to one end of said shaft, said putter head including a front face portion defining a ball striking surface, a rear face portion opposite thereof, and two end portions, the improvement wherein said putter head includes a pair of first and second head elements spaced from each other, said first head element defining a recessed pocket at said front face portion, resilient means circumferentially surrounding the pair of head elements of said putter head from end to end and laterally crossing said recessed pocket to define said ball striking surface, and means for selectively adjusting the tension of said resilient means and thereby modifying the resilience of said ball striking surface, wherein said tensioning adjustment means comprises a threaded bore defined within said second body element, a threaded tensioning member positioned within said bore and extending outwardly therefrom into the spacing between said first and second elements to engage the outer surface of said first head element for moving said second head element relative to said first head element and thereby changing the spacing between said first and second head elements and the tension of said resilient means, and a pair of guide pins projecting from the outer surface of said first head element into, respectively, a pair of apertures defined within said second head element and arranged on either side of said threaded bore.

* * * * *